US011799235B2

(12) United States Patent
Little et al.

(10) Patent No.: US 11,799,235 B2
(45) Date of Patent: Oct. 24, 2023

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Terrance F. Little, Fullerton, CA (US); Patrick R. Casher, North Aurora, IL (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 16 days.

(21) Appl. No.: 17/714,239

(22) Filed: Apr. 6, 2022

(65) Prior Publication Data

US 2022/0320786 A1 Oct. 6, 2022

Related U.S. Application Data

(60) Provisional application No. 63/200,957, filed on Apr. 6, 2021.

(51) Int. Cl.
*H01R 13/04* (2006.01)
*H01R 13/516* (2006.01)

(52) U.S. Cl.
CPC ..... *H01R 13/516* (2013.01); *H01R 13/04* (2013.01)

(58) Field of Classification Search
CPC .... H01R 13/516; H01R 13/04; H01R 12/721; H01R 13/405; H01R 13/6471; H01R 13/6473; H01R 13/502
See application file for complete search history.

(56) References Cited

U.S. PATENT DOCUMENTS

| | | | | |
|---|---|---|---|---|
| 8,764,464 | B2 | 7/2014 | Buck et al. | |
| 9,759,879 | B1 | 9/2017 | Takai et al. | |
| 9,837,740 | B2 | 12/2017 | Liao | |
| 10,128,620 | B1 * | 11/2018 | Wu | H01R 13/405 |
| 10,396,513 | B2 | 8/2019 | Regnier | |
| 10,644,455 | B1 * | 5/2020 | Champion | H01R 13/6464 |
| 11,043,780 | B2 | 6/2021 | Wang | |

(Continued)

*Primary Examiner* — Truc T Nguyen
(74) *Attorney, Agent, or Firm* — Ming Chieh Chang

(57) ABSTRACT

The electrical connector includes a contact module received within an insulative housing. The contact module includes an upper contact unit and a lower contacts unit stacked with each other. Each of the upper contact unit and the lower contact unit includes a front/outer contact part and a rear/inner contact part each including a plurality of side by side arranged contacts integrally formed with a plurality of plastic tie bars at different positions via insert-molding. An insulative front cover and an insulative rear cover are assembled upon the housing wherein the rear cover is forwardly assembled into the housing together with the contact module while the front cover is downwardly assembled upon the housing after the contact module has been assemble into the housing. The front cover is configured to comply with the curved resilient contacting sections of the contacts for lowering the impedance of the contacts thereabouts.

20 Claims, 11 Drawing Sheets

(56) References Cited

U.S. PATENT DOCUMENTS

| | | | | |
|---|---|---|---|---|
| 2006/0189219 | A1* | 8/2006 | Yamashita | H01R 13/4362 439/752 |
| 2009/0061695 | A1* | 3/2009 | Ko | H01R 13/65918 439/682 |
| 2017/0033506 | A1* | 2/2017 | Hsu | H01R 13/629 |
| 2018/0090887 | A1* | 3/2018 | Little | H01R 13/6594 |
| 2019/0020152 | A1* | 1/2019 | Little | H01R 13/6658 |
| 2019/0089106 | A1 | 3/2019 | Regnier | |
| 2019/0207348 | A1* | 7/2019 | Wu | H01R 13/6585 |
| 2022/0021158 | A1 | 1/2022 | Little et al. | |
| 2022/0216635 | A1* | 7/2022 | Little | H01R 13/514 |
| 2022/0329032 | A1* | 10/2022 | Little | H01R 12/75 |

* cited by examiner

ELECTRICAL CONNECTOR

CROSS REFERENCE TO RELATED APPLICATION

This application claims priority to U.S. Application No. 63/200,957, filed Apr. 6, 2021, the content of which is incorporated herein by reference in its entirety.

BACKGROUND OF THE INVENTION

1. Field of the Invention

The present invention relates generally to an electrical connector having the corresponding contact module equipped with grounding bars. This invention is an improvement to provisional application 63/134,557 filed on Jan. 6, 2021 which is an improvement of provisional application 63/053,611 filed on Jul. 18, 2020.

2. Description of Related Art

U.S. Pat. No. 11,043,780 discloses an electrical connector comprising an insulative housing and a contact module received in the insulative housing. The contact module comprises an upper module comprising a first contact module and a second contact module disposed below the first contact module, and a lower module comprising a third contact module and a fourth contact module disposed between the second contact module and the third contact module. The first contact module having a plurality first contacts having a length longer than a length of contacts of the second, the third, the forth contact modules. Therefor, the impedance of the first contacts may be too high to affect the high speed signal transmitting.

SUMMARY OF THE INVENTION

An object of the present invention is to provide an electrical connector having improved impedance.

The electrical connector includes a contact module received within an insulative housing which has a plurality of passageways therein. The contact module includes an upper contact unit and a lower contacts unit stacked with each other. Each of the upper contact unit and the lower contact unit includes a front/outer contact part and a rear/inner contact part each including a plurality of side by side arranged contacts integrally formed with a plurality of plastic tie bars at different positions via insert-molding. The contacts include a plurality of differential pair signal contacts and a plurality of grounding contacts alternately arranged with each other along a transverse direction. Each plastic tie bar includes an insulative primary part integrally formed with all contacts via a first insert-molding process, and a conductive secondary part integrally formed with the primary part and the grounding contacts via a second insert-molding process after the first insert-molding process. A pair of metallic plates are located on two opposite sides of the upper contact unit and the lower contact unit of the contact module, and forms a plurality of holes to receive therein the corresponding holding lugs formed on two opposite ends of the corresponding tie bars, respectively, so as to secure the whole contact module together. An insulative front cover is downwardly, along a vertical direction, assembled into a front region of the housing and includes a plurality of blades extending into the corresponding passageways of the housing and confronting the mating sections of the corresponding contacts of the front/outer contact part of the upper contact unit. An insulative rear cover is associated with the contact module to be forwardly, along a front-to-back direction, inserted into the housing.

According to the present invention, the electrical connector comprises an insulative front cover assembled into a front region of the housing. Therefore, the impedance of the contacts is reduced.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1A:
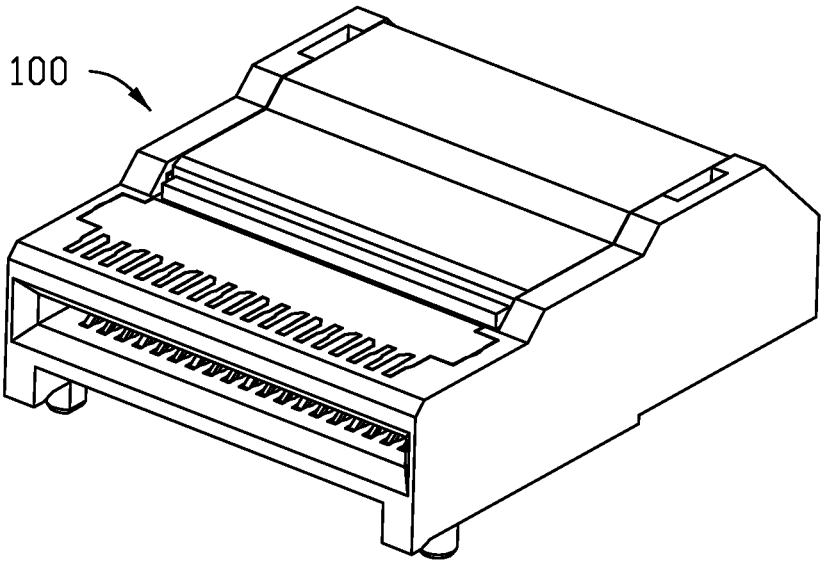
FIG. 1(A) is a perspective view front of an electrical connector according to the first invention.
Figure 1B:
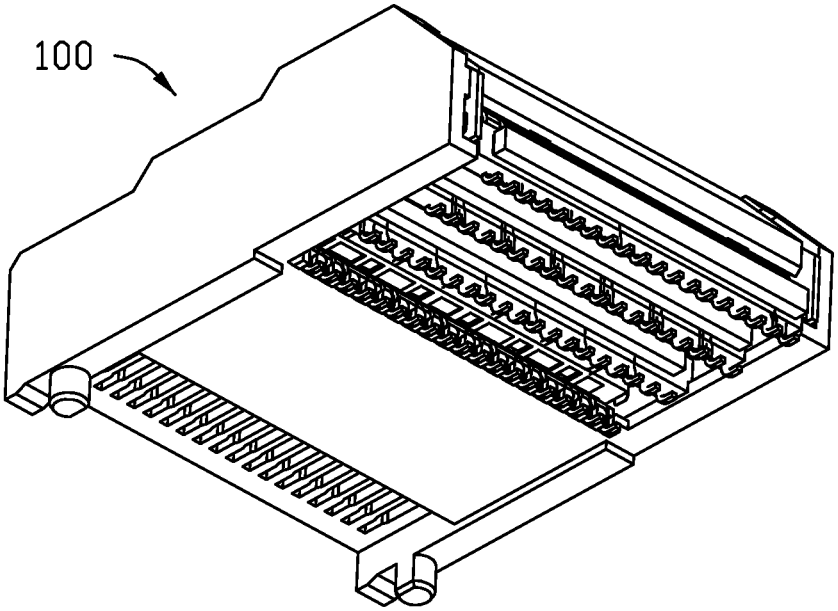
FIG. 1(B) is another perspective view of the electrical connector of FIG. 1(A)
Figure 2A:
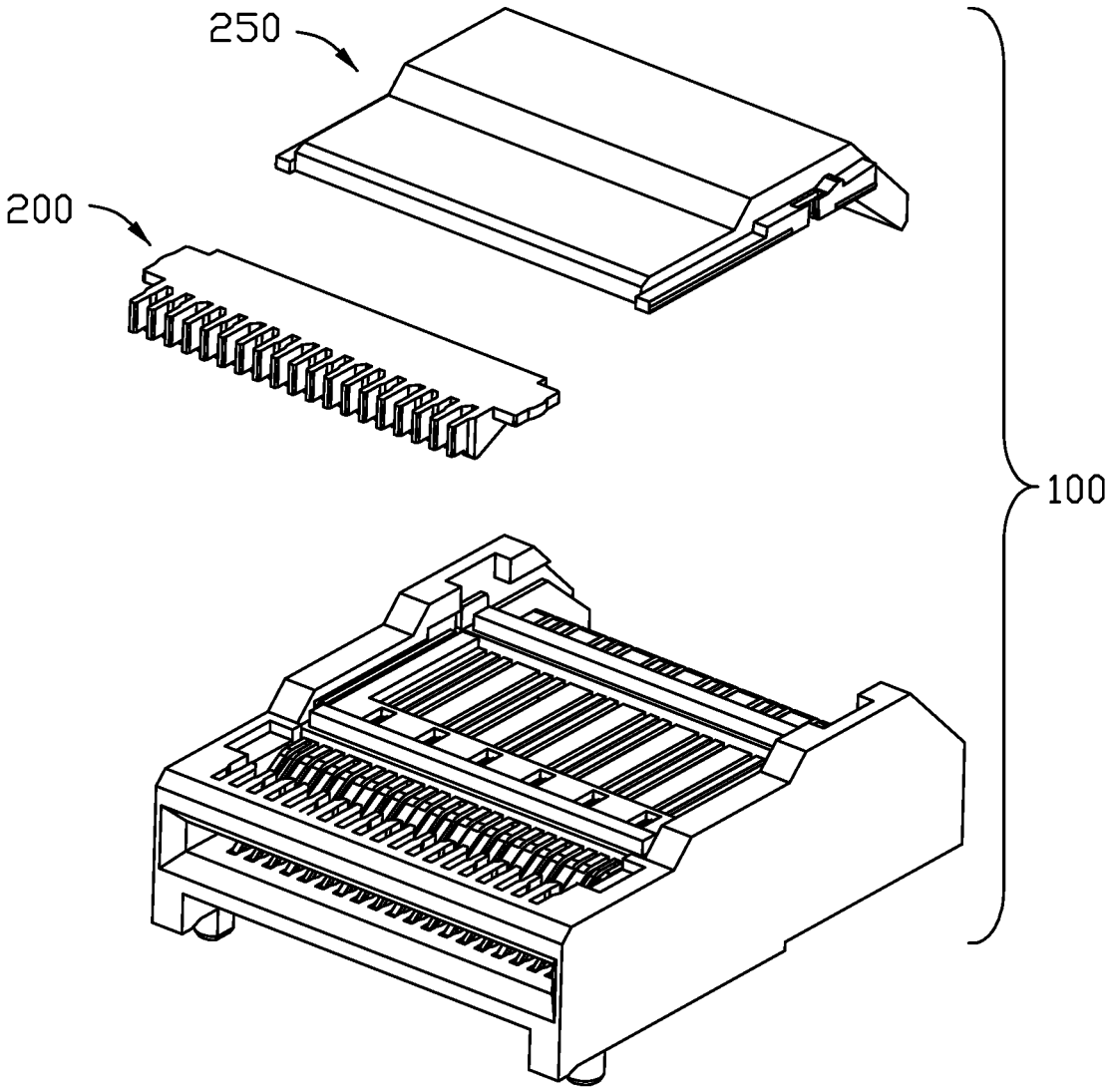
FIG. 2(A) is an exploded perspective view of the electrical connector of FIG. 1(A)
Figure 2B:
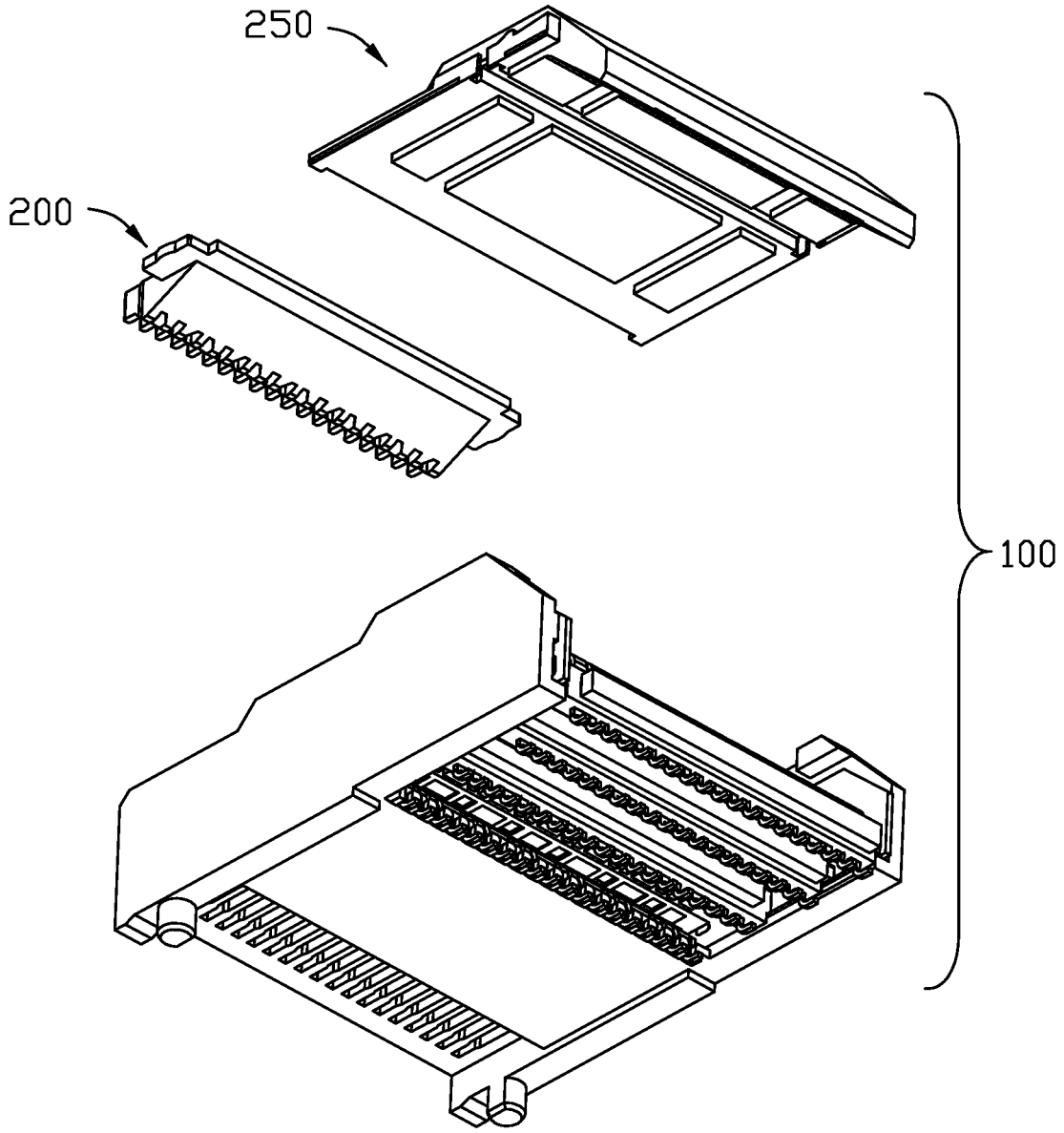
FIG. 2(B) is another exploded perspective view of the electrical connector of FIG. 2(A)
Figure 3A:
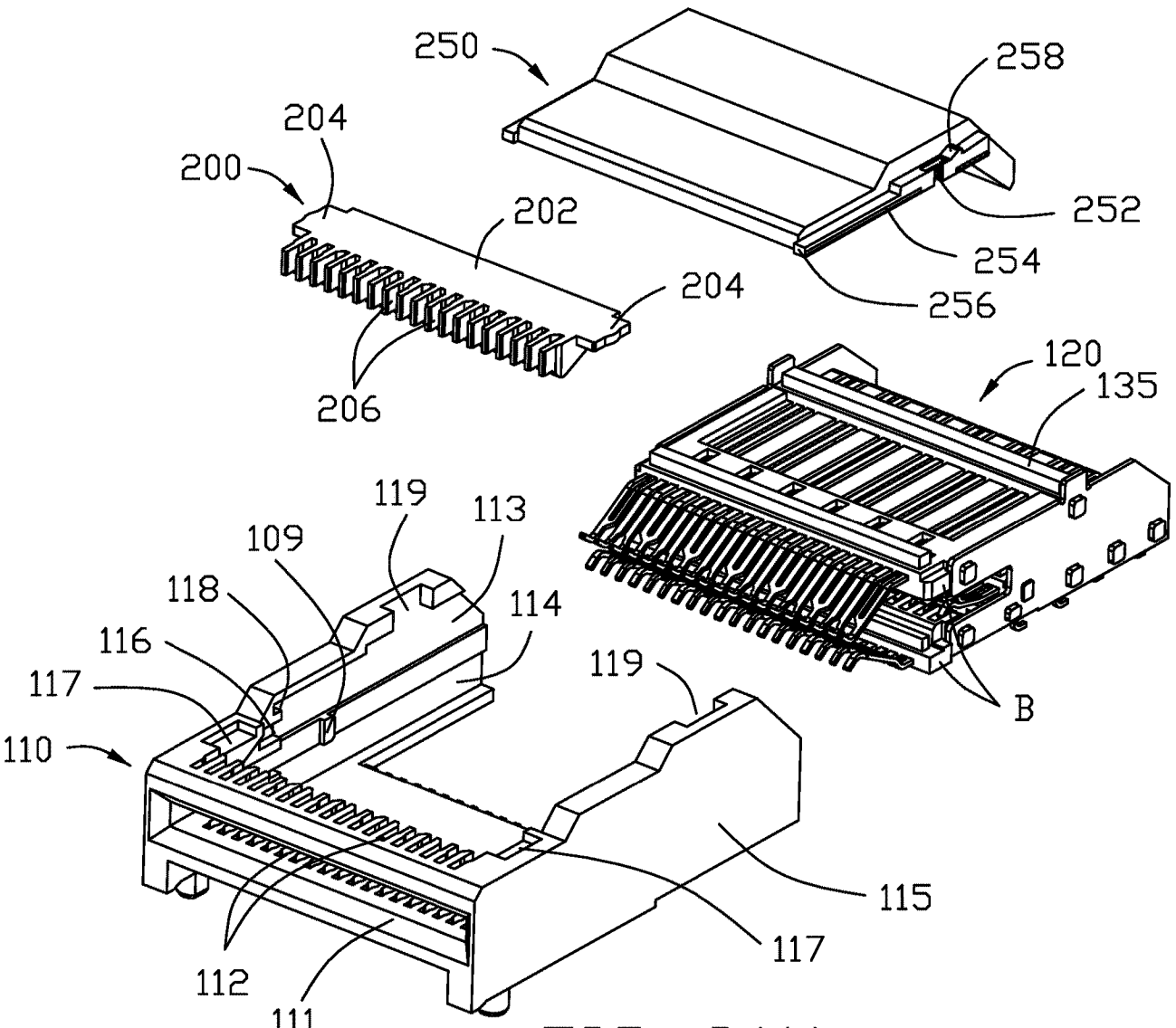
FIG. 3(A) is a further exploded perspective view of the electrical connector of FIG. 2(A)
Figure 3B:
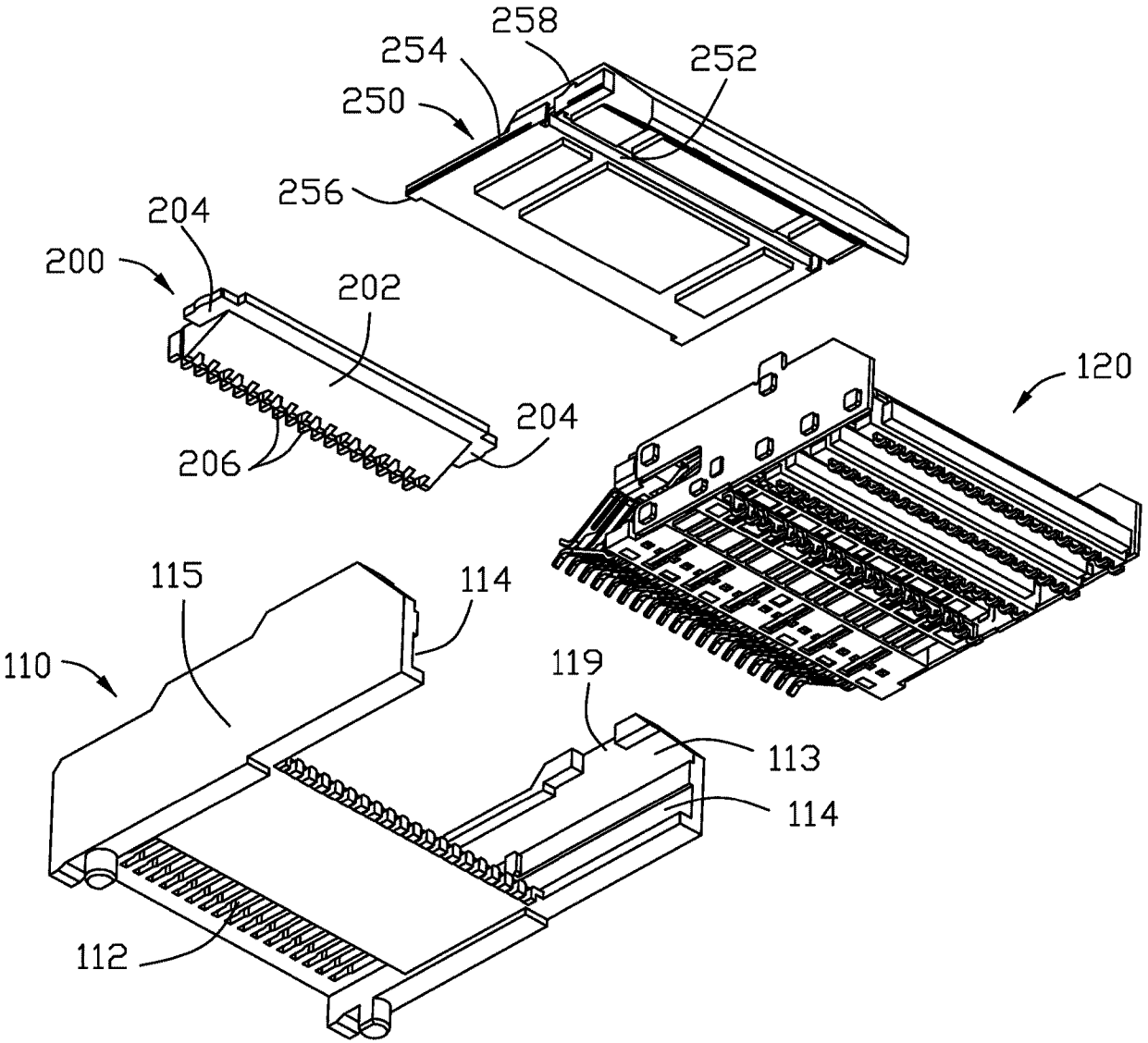
FIG. 3(B) is another exploded perspective view of the electrical connector of FIG. 3(A)
Figure 4A:
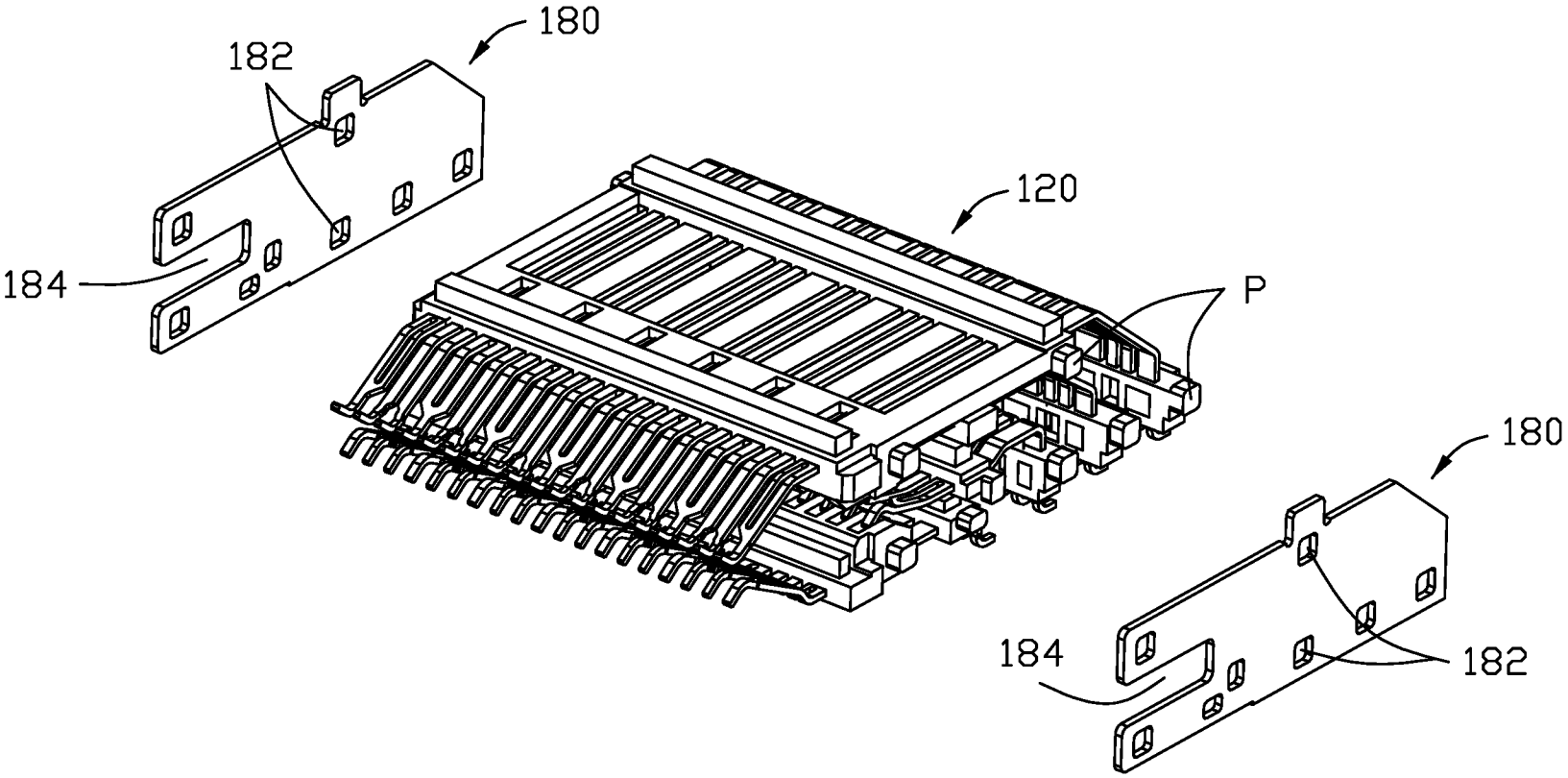
FIG. 4(A) is an exploded perspective view of the contact module of the electrical connector of FIG. 3(A)
Figure 4B:
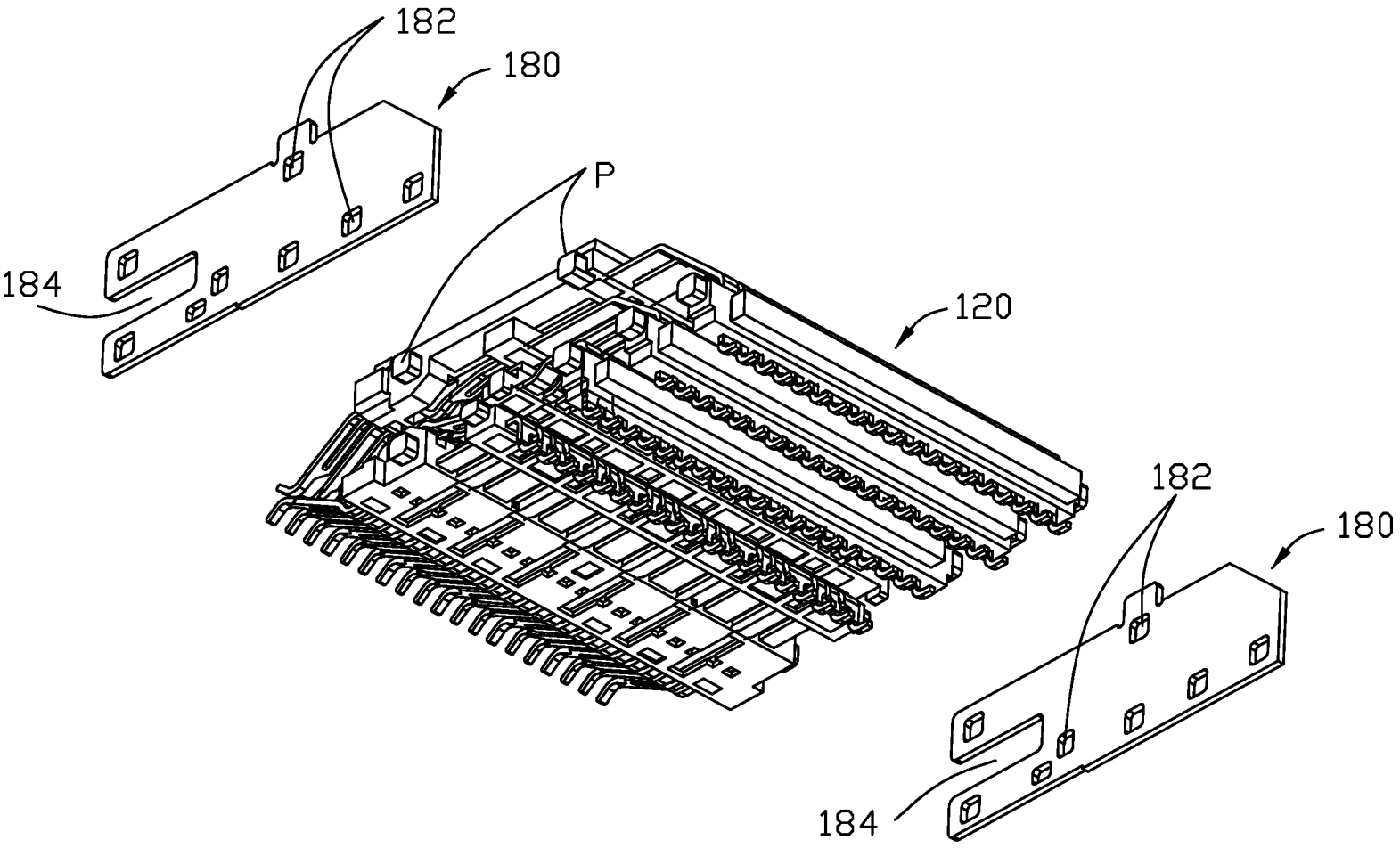
FIG. 4(B) is another exploded perspective view of the contact module of the electrical connector of FIG. 4(A)

Reference will now be made in detail to the embodiments of the present disclosure.

Referring to FIGS. 1(A)-6, an electrical connector 100 includes an insulative housing 110 cooperating with an insulative front cover 200 and an insulative rear cover 250 to commonly receive a contact module 120 therein. The contact module 120 includes an upper contact unit 122 and a lower contact unit 124 stacked with each other in the vertical direction in essentially a mirror image arrangement. The upper contact unit 122 includes an upper front/outer contact part 130 and an upper rear/inner contact part 140 stacked with each other in the vertical direction, and the lower contact unit 124 includes a lower front/outer contact part 160 and a lower rear/inner contact part 150 stacked with each other in the vertical direction.

The upper front/outer contact part 130 includes a plurality of contacts 132 integrally formed with a plurality of transversely extending plastic tie bars 135 via insert-molding. Each plastic tie bar 135 includes an insulative primary part 134 and a conductive secondary part 136. Similarly, the upper rear/inner contact part 140 includes a plurality of contacts 142 integrally formed with a plurality of transversely extending plastic tie bars 145 via insert-molding and each plastic tie bar 145 includes an insulative primary part 144 and a conductive secondary part 146; the lower front/ outer contact part 160 includes a plurality of contacts 162 integrally formed with a plurality transversely extending plastic tie bars 165 via insert-molding and each plastic tie bar includes an insulative primary part 164 and a conductive secondary part 166; the lower rear/inner contact part includes a plurality of contacts 152 integrally formed with a plurality of transversely extending plastic tie bars 155 via insert-molding and each plastic tie bar 155 includes an insulative primary part 154 and a conductive secondary part 156.

Each group of the contacts 132, 142, 152 and 162 includes a plurality of differential-pair signal contacts and a plurality of grounding contacts alternately arranged with each other in the transverse direction. Each contact 132, 142, 152 and 162 includes a front deflectable contacting section 171, a rear soldering section 173 and a retaining section 172. Understandably, the grounding contacts are further joined together by the corresponding conductive secondary part.

Figure 5A:
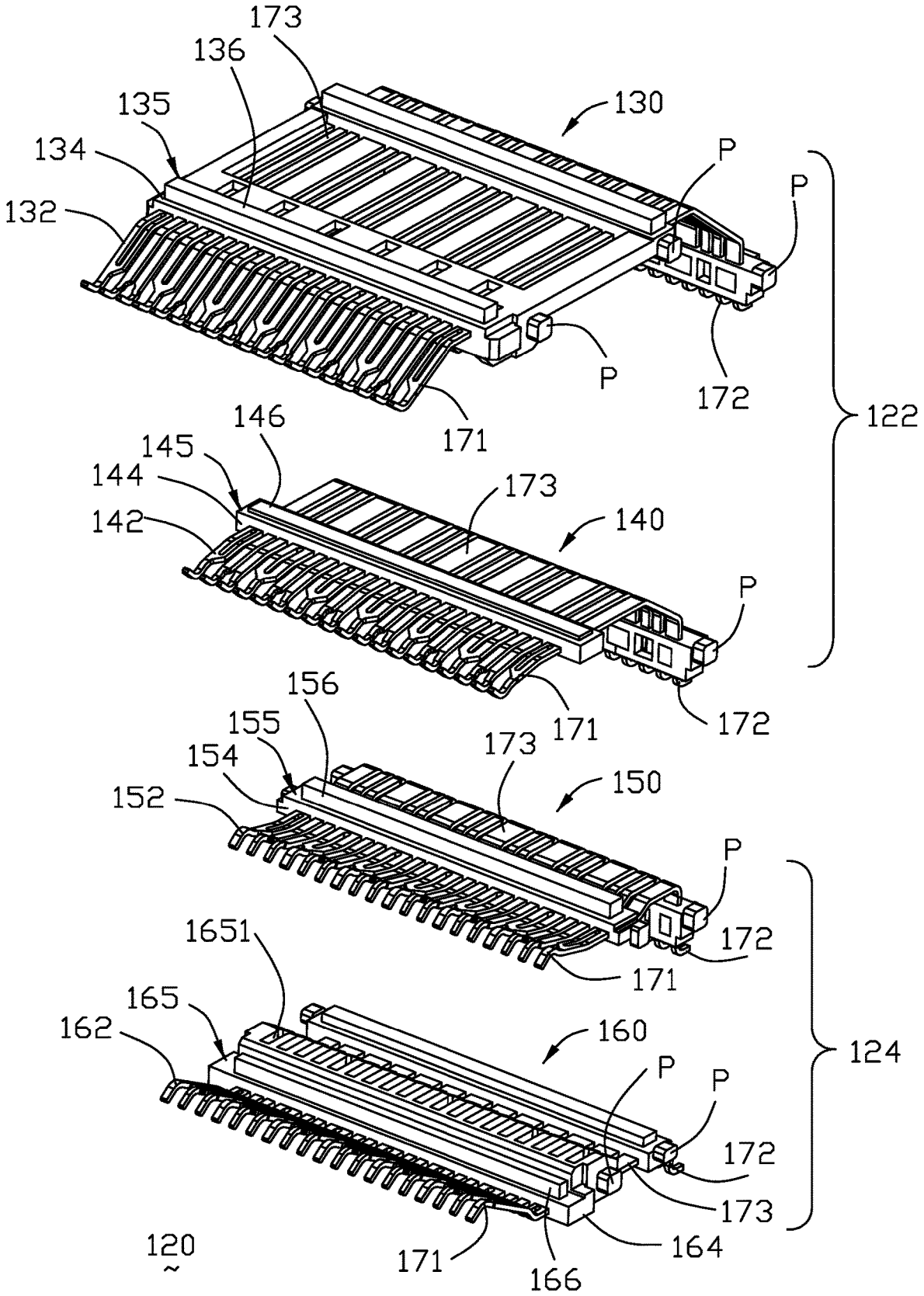
FIG. 5(A) is a further exploded perspective view of the contact module of the electrical connector of FIG. 4(A) without showing the pair of side plates.
Figure 5B:
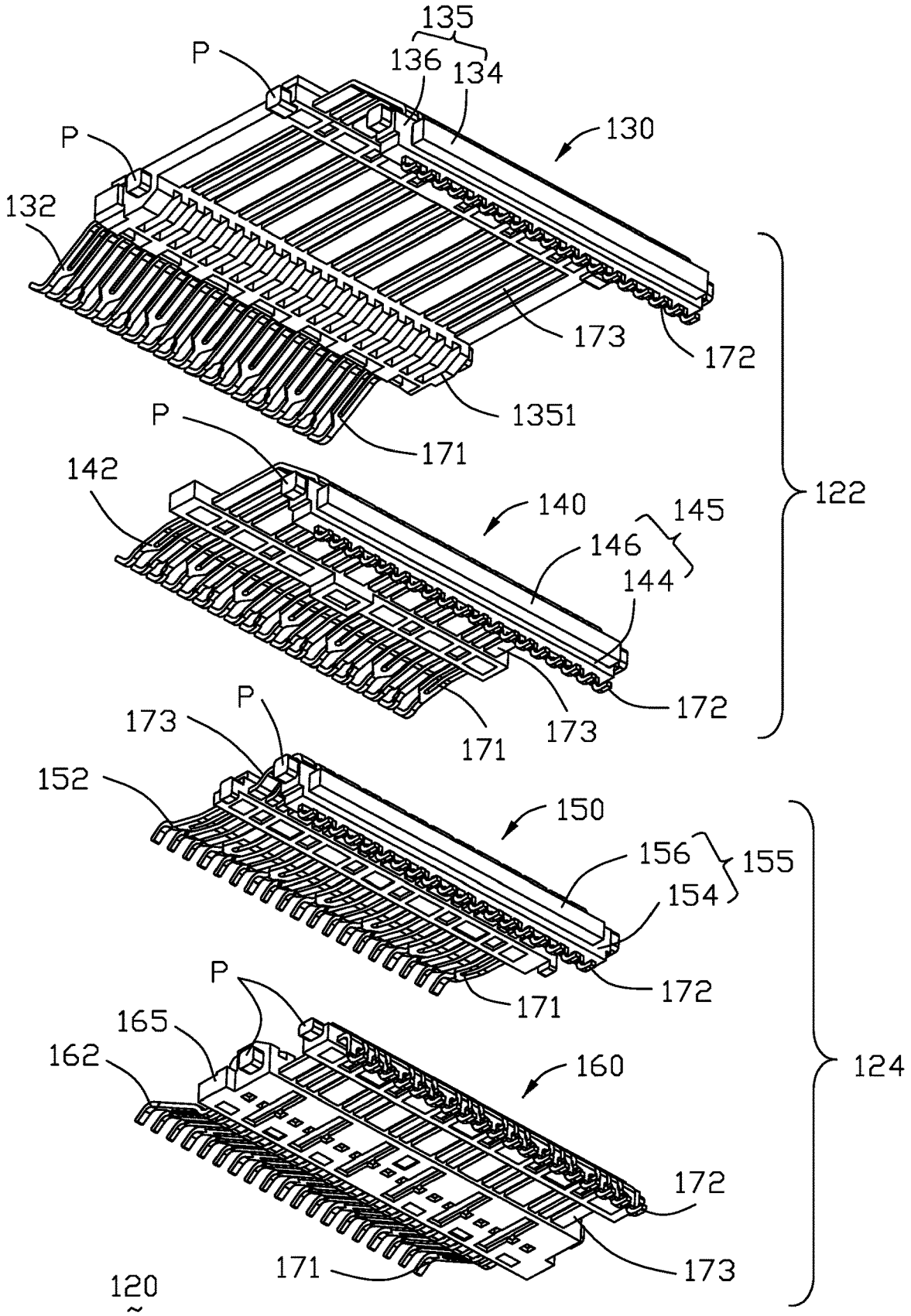
FIG. 5(B) is another exploded perspective view of the contact module of the electrical connector of FIG. 5(A)
Figure 6:
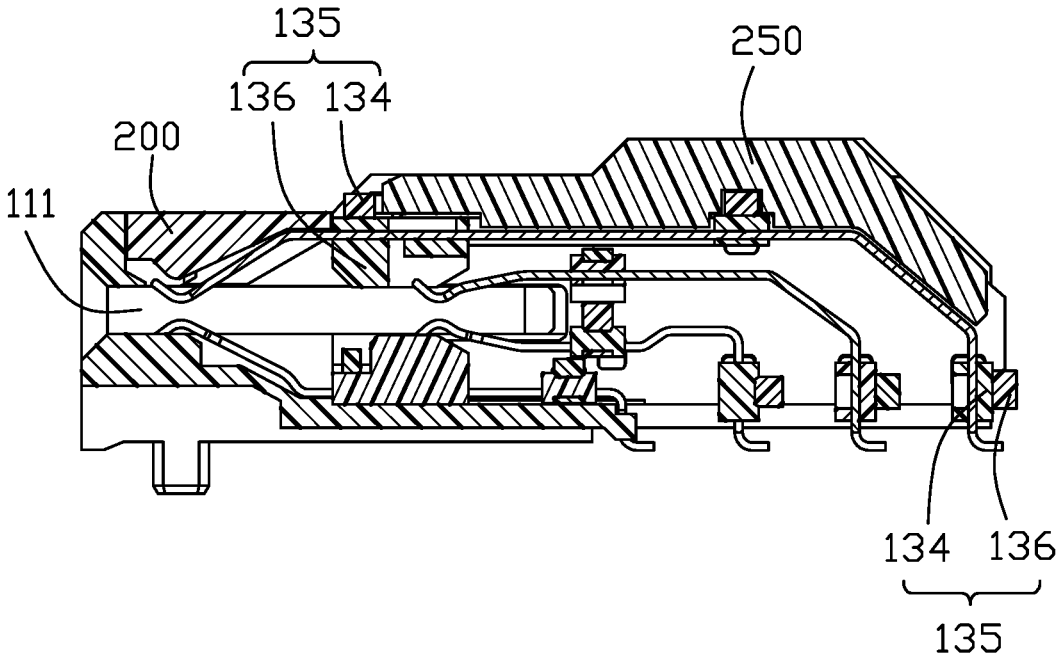
FIG. 6 is a cross-sectional view of the electrical connector of FIG. 1(A).

A pair of metallic side plates 180 are located by two opposite sides of the upper contact unit 122 and the lower contact unit 124 of the contact module 120, respectively. Each side plate 180 forms a plurality of holes 182 therein. Correspondingly, each plastic bar 135, 145, 155 and 165 includes a pair of positioning protrusions or holding lugs P at two opposite ends to be received within the corresponding holes 182, respectively, so as to secure the whole contact module 120 together. Each side plate 180 forms a notch 184 aligned with the contact sections 171 of the contacts 142 and those of the contacts 152 in the transverse direction. Notably, as shown in FIG. 5(A) one plastic tie bar 165 forms a plurality of grooves 1651 to respectively receive the contacting sections 171 of the corresponding contacts 152, and as shown in FIG. 5(B) one plastic tie bar 135 forms a plurality of grooves 1351 to respectively receive the contacting sections 171 of the corresponding contacts 142.

A front region of the housing 110 forms a mating slot 111, and upper and lower rows of passageways 112 located by two sides of the mating slot 111 in the vertical direction wherein the upper row of passageways 112 respectively receive the contacting sections 171 of the contacts 132, and the lower row of passageways 112 respectively receive the contacting sections 171 of the contacts 162.

A rear region of the housing 110 forms a pair of upper channels 113 and a pair of lower channels 114 in two opposite side walls 115. Correspondingly, the positioning protrusions P are arranged in upper and lower rows to be respectively received within the upper channels 113 and the lower channels 114. Therefore, the assembled contact module 120 can be forwardly, along the front-to-back direction, inserted into the housing 110 from the rear side. The housing 110 further includes a plurality of recesses 116 (only one shown in FIG. 3(A) to receive the corresponding engagement blocks B on the corresponding plastic tie bars to firmly secure the contact module 120 in the housing 110. A pair of stopping blocks 109 are formed on inner faces of the side walls 115 to be received within the corresponding notch 184 of the corresponding side plate 180.

An insulative front cover 200 is downwardly assembled upon the front region of the housing 110, and includes an elongated main body 202 with a pair of engagement sections or mounting ears 204 at two opposite ends in the transverse direction, and a plurality of blades 206 received within the corresponding passageways 112 to reduce impedance of the contacts 132. In this manner, the impedance of the contacts 132 is reduced by 2-5 ohms. The front region of the housing 110 forms a pair of recessions 117 to receive the corresponding engagement sections 206 in an interference fit. An insulative rear cover 250 includes a slot 252 extending in the transverse direction to receive one plastic tie bar 135 therein, and a pair of guiding ribs 254 having front ends 256 received within the locking slots 118 in the upper channel 113, and a bump section 258 received within the locking space 119 in the upper channel 113. Therefore, the rear cover 250 is designedly associated with the contact module 120 to be commonly forwardly, along the front-to-back direction, inserted into the housing 110 from the rear side of the housing 110.

In addition to the features disclosed in the aforementioned front cover 200 and rear cover 250, another feature of the front cover 200 is to have the corresponding blades 206 configured to be compliant with the curved resilient contacting section 171. Therefore, the front cover 200 is assembled to the housing 110 only after the contact module 120 has been assembled into the housing 110. Notably, compared with the aforementioned previous provisional application 63/134,557, the invention further provides the front cover 200 to not only mechanically shield the inside contacts for dust or touching prevention, but also electrically efficiently lower the impedance therearound. Understandably, in the instant embodiment the front cover 200 shield the contacting sections 171 of the contacts 132. Alternately, an additional front cover can be used to shield the contacting sections 171 of the contacts 162.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining a mating slot and two rows of passageways by two sides in a vertical direction;

a contact module essentially composed of an upper contact unit and a lower contact unit arranged together in the vertical direction, each of the upper contact unit and the lower contact unit including a plurality of contacts integrally formed with a plurality of plastic tie bars extending in a transverse direction perpendicular to the vertical direction;

each contact defining a front resilient contacting section, a rear mounting section and a middle retaining section therebetween in the front-to-back direction perpendicular to both the vertical direction and the transverse direction; and an insulative front cover downwardly attached upon a front region of the housing and including a plurality of blades extending into the corresponding passageways to intimately confront the contacting sections of the corresponding contacts, respectively.

2. The electrical connector as claimed in claim 1, wherein the contacting section is curved, and the corresponding blade is curved to comply therewith.

3. The electrical connector as claimed in claim 1, wherein the blades are configured to require the insulative front cover to be assembled upon the housing only after the contact module is assembled into the housing for avoiding any interference between the contacting sections of the contacts and the corresponding blades.

4. The electrical connector as claimed in claim 1, wherein the contact module further includes a pair of metallic side plates with corresponding holes to hold the upper contact unit and the lower contact unit together.

5. The electrical connector as claimed in claim 4, wherein the insulative housing comprises stopping blocks, and each of the side plates forms a notches mated with the stopping blocks, respectively.

6. The electrical connector as claimed in claim 1, further comprising an insulative rear cover coupling the corresponding plastic tie bar, wherein the rear cover and the contact module together are forwardly assembled into the housing from a rear side of the housing.

7. The electrical connector as claimed in claim 1, wherein the upper contact unit comprises an upper front/outer contact part and an upper rear/inner contact part stacked with each other in the vertical direction, and the lower contact unit comprises a lower front/outer contact part and a lower rear/inner contact part stacked with each other in the vertical direction.

8. The electrical connector as claimed in claim 7, wherein the tie bar of the upper front/outer contact part forms a plurality of grooves to respectively receive the contacting sections of the contacts of the upper rear/inner contact part, and the tie bar of the lower front/outer contact part forms a plurality of grooves to respectively receive the contacting sections of the contacts of the lower rear/inner contact part.

9. The electrical connector as claimed in claim 1, wherein the contacts of the upper contact unit and a lower contact unit comprises a plurality of differential-pair signal contacts and a plurality of grounding contacts alternately arranged with each other in the transverse direction.

10. The electrical connector as claimed in claim 9, wherein each of the plastic tie bars comprises an insulative primary part and a conductive secondary part electrically joined the grounding contacts together.

11. The electrical connector as claimed in claim 1, wherein the insulative housing defines passageways, and the contact module comprises positioning protrusions mated with the passageways respectively to assemble the contact module forwardly from a rear side of the insulative housing into the insulative housing.

12. The electrical connector as claimed in claim 1, wherein the insulative front cover comprises an elongated main body with a pair of engagement sections at two opposite ends in the transverse direction.

13. An electrical connector comprising:

an insulative housing defining a mating slot and a top opening;

a plurality of contacts divided into upper contacts arranged in an upper row along a transverse direction and lower contacts arranged in a lower row opposite to the upper row along a vertical direction;

each contact defining a front resilient contacting section, a rear mounting section, and a middle retaining section therebetween in the front-to-back direction perpendicular to both the vertical direction and the transverse direction; and an insulative front cover downwardly attached to the top opening adjacent to the contacting sections and comprising a plurality of blades extending into the insulative housing to intimately confront the contacting sections of the corresponding contacts respectively to reduce impedance.

14. The electrical connector as claimed in claim 13, wherein the impedance of the contacts is reduced by 2-5 ohms.

15. The electrical connector as claimed in claim 13, further comprising an insulative rear cover cooperating with the insulative front cover to seal the top opening.

16. The electrical connector as claimed in claim 15, wherein the upper contacts are fixed by a plurality of plastic tie bars, and the lower contacts are fixed by a plurality of plastic tie bars, each of the plastic tie bars comprising an insulative primary part and a conductive secondary part.

17. The electrical connector as claimed in claim 16, wherein the insulative rear cover couples the corresponding plastic tie bar, wherein the rear cover and the contact module together are forwardly assembled into the housing from a rear side of the housing.

18. The electrical connector as claimed in claim 13, wherein the blades are configured to require the insulative front cover to be assembled upon the housing only after the contacts are assembled into the housing for avoiding any interference between the contacting sections of the contacts and the corresponding blades.

19. The electrical connector as claimed in claim 13, wherein the contacting section is curved, and the corresponding blade is curved to comply therewith.

20. An electrical connector comprising:

an insulative housing defining a mating slot;

a contact module comprising an upper contact unit and a lower contact unit arranged together in the vertical direction, the upper contact unit comprising an upper front/outer contact part and an upper rear/inner contact part stacked with each other in the vertical direction, and the lower contact unit comprising a lower front/outer contact part and a lower rear/inner contact part stacked with each other in the vertical direction;

each contact defining a front resilient contacting section, a rear mounting section, and a middle retaining section therebetween in the front-to-back direction; and an insulative front cover downwardly attached to the insulative housing and comprising a plurality of blades extending into the insulative housing to intimately confront the contacting sections of the corresponding contacts respectively to reduce impedance.

* * * * *